US008840761B2

(12) United States Patent
Woiceshyn

(10) Patent No.: US 8,840,761 B2
(45) Date of Patent: Sep. 23, 2014

(54) METHOD FOR CONTAMINANT REMOVAL IN PAPER PRODUCTION

(75) Inventor: Daniel Mark Woiceshyn, Grimsby (CA)

(73) Assignee: Imerys Talc America, Inc., Roswell, GA (US)

( * ) Notice: Subject to any disclaimer, the term of this patent is extended or adjusted under 35 U.S.C. 154(b) by 0 days.

(21) Appl. No.: 13/156,066

(22) Filed: Jun. 8, 2011

(65) Prior Publication Data

US 2011/0303378 A1 Dec. 15, 2011

Related U.S. Application Data

(60) Provisional application No. 61/353,943, filed on Jun. 11, 2010.

(51) Int. Cl.

| | |
|---|---|
| ***D21H 21/02*** | (2006.01) |
| ***D21H 21/00*** | (2006.01) |
| ***D21H 17/63*** | (2006.01) |
| ***D21H 17/67*** | (2006.01) |
| ***D21H 23/24*** | (2006.01) |

(52) U.S. Cl.

CPC ..... *D21H 17/67* (2013.01); *D21H 21/02* (2013.01)

USPC ..... 162/181.6; 162/158; 162/181.1; 162/189; 162/190

(58) Field of Classification Search

USPC ..... 162/189, 190, 158, 181.1, 181.6

See application file for complete search history.

(56) References Cited

U.S. PATENT DOCUMENTS

| | | | | |
|---|---|---|---|---|
| 4,243,480 | A | 1/1981 | Hernandez et al. | |
| 4,504,358 | A * | 3/1985 | Hakansson | 162/264 |
| 5,133,832 | A | 7/1992 | Gilkey | |
| 5,676,796 | A * | 10/1997 | Cutts | 162/164.3 |
| 5,798,023 | A * | 8/1998 | Pruszynski et al. | 162/181.1 |
| 6,083,348 | A * | 7/2000 | Auhorn et al. | 162/181.1 |
| 7,234,857 | B2 * | 6/2007 | Matula | 366/167.1 |
| 2003/0205344 | A1 | 11/2003 | Lasmarias et al. | |
| 2006/0048908 | A1 | 3/2006 | Wang et al. | |
| 2008/0035292 | A1 | 2/2008 | Singh et al. | |
| 2008/0078519 | A1 * | 4/2008 | Jiang et al. | 162/199 |
| 2009/0120596 | A1 * | 5/2009 | Francis et al. | 162/5 |

FOREIGN PATENT DOCUMENTS

| | | |
|---|---|---|
| EP | 0 541 457 A1 | 5/1993 |
| SU | 907117 B | 2/1982 |

OTHER PUBLICATIONS

Hubbe et al "Control of tacky deposits on paper machines—A review" Nordic Pulp and Paper Research Journal, v. 21, No. 2 [online] 2006, pp. 154-171, [retrieved from the Internet], retrieved Mar. 16, 1012, <URL: http://repository.lib.ncsu.edu/publications/bitstream/1840.2/14/1/HubbeM_06_RV_Deposit_Control_PMs.pdf>.*

Project Ecotarget, "New and innovative processes for radical changes in the European pulp & paper industry", Report of Project Deliverables, 2004, [online], pp. 1-10, retrieved from the Internet, [Retrieved Jul. 31, 2013], <URL: http://www.ecotarget.eu/news/ECOTARGET%20Technical%20deliverable%20D5.3.2.pdf>.*

Blanco, Angeles; Miranda, Ruben; Negro, Carlos; Garcia-Suarez, Concepcion; Garcia-Prol, Marta; and Sanchez, Alvaro, "Full characterization of stickies in a newsprint mill: the need for a complementary approach" TAPPI Journal, vol. 6, No. 1, Jan. 2007, pp. 19-25.

Search Report and Written Opinion for related PCT Application No. PCT/US11/39631, dated Oct. 20, 2011.

Yordan, Jorge L.; Biza, Peter; and Williams, Gary, "Talc for Contaminant Control in Recycled Fiber", *Recent Advances in Paper Recycling—Stickies*, 2002, pp. 173-177.

* cited by examiner

*Primary Examiner* — Dennis Cordray

(74) *Attorney, Agent, or Firm* — Finnegan, Henderson, Farabow, Garrett & Dunner, L.L.P.

(57) ABSTRACT

The present invention relates to a process for controlling deposits in a paper making process, more particularly to a process comprising the use of talc for controlling deposits in a paper making process with talc. One aspect of the invention is contacting talc with a white water stream at one or more locations within the paper making process after separating pulp from a pulp-containing stream and before introducing the re-circulating the white water stream to one or more of a pulper, a thick-stock, a thin-stock, a dilution process, a shower, a storage vessel, a blending process, and a digestor.

24 Claims, 1 Drawing Sheet

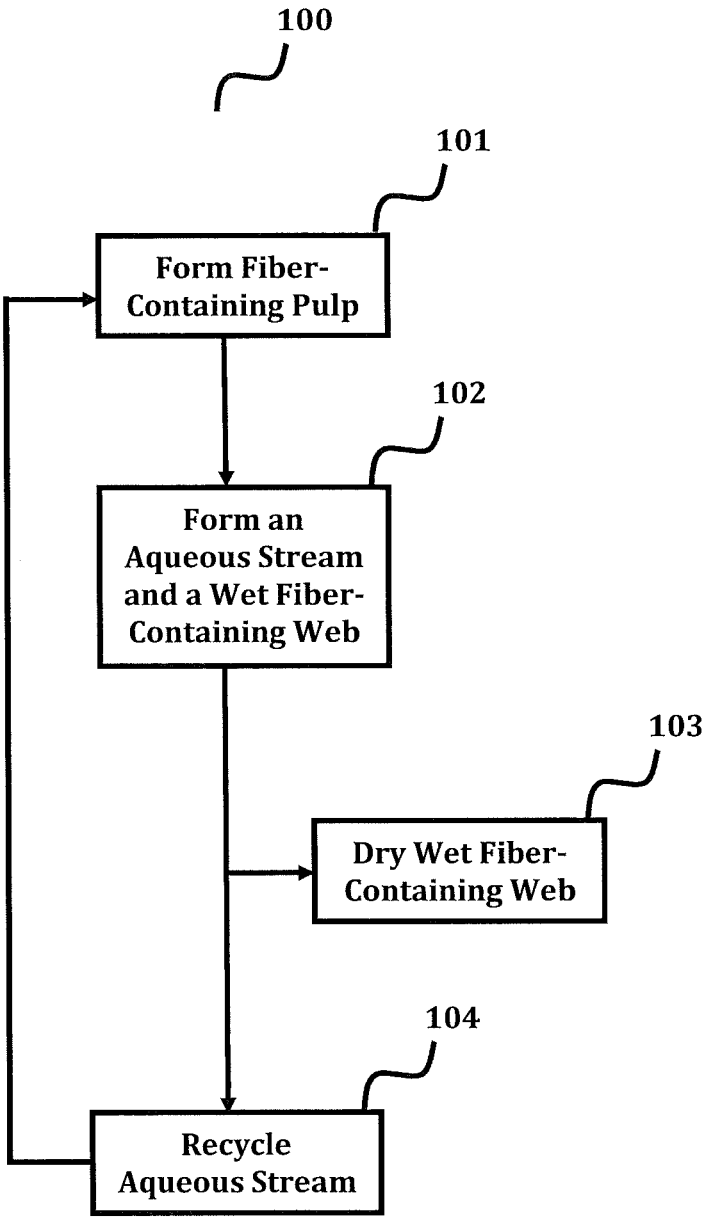
100
101
Form Fiber-Containing Pulp
102
Form an Aqueous Stream and a Wet Fiber-Containing Web
103
Dry Wet Fiber-Containing Web
104
Recycle Aqueous Stream

METHOD FOR CONTAMINANT REMOVAL IN PAPER PRODUCTION

REFERENCE TO RELATED APPLICATION

This application claims priority to U.S. Provisional Patent Application Ser. No. 61/353,943, filed Jun. 11, 2010, entitled "Method for Contaminant Removal in Paper Production," which is incorporated herein by reference.

FIELD OF INVENTION

The present application relates to a process for controlling deposits in a paper making process, more particularly to a process comprising the use of talc for controlling deposits in a paper making process.

BACKGROUND OF THE INVENTION

Paper is typically made by casting a wet-web of fibers from an aqueous dispersion of the fibers. Drying the cast wet-web forms the paper.

Typically the fibers are wood and/or cellulosic fibers. Wood used in paper making naturally contains depositional material (such as oils, waxes, resins and fatty acids). Furthermore, many papermaking processes use recycled fiber sources, such as recycled wood and paper. The recycled wood and paper typically contain large amounts of secondary depositional material in addition to the naturally occurring depositional material. The secondary depositional materials typically comprise printing inks, binding agents, coatings, sizing agents, surfactants, wet strength resins, and the like.

During the papermaking process, the depositional material can be problematic because it builds up on papermaking machinery. The build-up of the depositional material can cause failure of the papermaking machinery and complicate effective operation of the papermaking machinery. Furthermore, the depositional material can impact the quality of the paper when transferred to the paper. Paper containing the depositional material can be difficult to process due to the depositional material sticky nature.

For example, the depositional material typically forms deposits on sieves and felts, which serve as supports for casting and drying the wet-web. The deposits are commonly sticky and agglomerate on the papermaking machinery, within the cast wet-web or both. The deposits can cause breakage of the wet-web, voids within the paper and/or spots within and/or discoloration of the paper. In many instances, production must be stopped for the removal of the deposits from the papermaking machinery.

A need exists for more effectively controlling and/or inhibiting the deposition of the depositional material on papermaking machinery and/or within wet-webs in papermaking processes.

SUMMARY OF THE INVENTION

One embodiment of the present invention is a process for reducing depositional material in a paper making process. This process includes contacting talc with an aqueous stream in the paper making process which is characterized by the aqueous stream having a low long fiber content.

Another embodiment of the present invention is a process for reducing depositional material in a paper making process that includes separating pulp from a pulp-containing stream to form a re-circulating water stream. This process further includes adding talc to the re-circulating water stream before introducing this stream to a stream having a pulp content higher than the pulp content of the re-circulating stream.

A further embodiment of the present invention is a process for making paper products. This process includes contacting a wood based fiber-containing material with water to form a woody fiber-containing stream. The woody fiber-containing stream is contacted with a pulp-retention device to form a wet paper sheet and a white water. The process further includes drying the wet paper sheet to faun a dry paper sheet and contacting the white water with talc to form a talc-containing white water. The process further includes circulating at least a portion of the talc-containing white water to the step of contacting the woody fiber-containing material with water.

A still further embodiment of the present invention is a process for reducing depositional material in a paper making process. This process includes separating pulp from a pulp-containing stream to form an aqueous stream and adding talc to the aqueous stream before introducing the aqueous stream to a stream having a pulp content higher than the pulp content of the aqueous stream. This process is characterized by the aqueous stream having a low long fiber content and an elevated depositional index.

In various embodiments of the present invention, different streams, including aqueous streams having a low long fiber content, a re-circulating water stream, or a white water stream, have an elevated depositional index. More particularly, an elevated depositional index can be greater than the average depositional index for the paper making process or it can be greater than the upper quartile of depositional indices for the paper making process. In other such embodiments, the depositional index of the various streams can be reduced by at least about 30%.

In various embodiments of the present invention, the depositional material can be an oil, wax, resin, polymeric material, fatty acid-containing compositions, or mixtures thereof. The step of contacting talc with a stream in the present invention can form depositional material-loaded talc and a depositional material-depleted stream. In other embodiments, processes of the present invention can reduce the amount of depositional material in the various streams by at least about 10 wt % or at least about 20 wt %. In embodiments where the depositional material is a fatty acid, and the stream to which talc is added has a fatty acid-containing material content prior to adding the talc, addition of the talc can reduce the fatty acid-containing material content to at least about 10% less than the original fatty acid-containing material content.

In various embodiments of the present invention, an aqueous stream, a re-circulating water stream, or a white water stream can be formed by separating wood pulp from a wood pulp-containing stream. For example, the step of separating can be one of either a physical separation process or a floatation separation process. Specifically, the step of separating pulp from a pulp-containing stream can include use of a wire screen, a physical separation process other than a wire screen, or a floatation process.

In addition, processes of the present invention can include the introduction of talc to an aqueous stream, a re-circulating water stream, or a white water stream that is quiescent. In such embodiments, the talc can be in the form of fine particles. In other embodiments, the talc can be contacted with a stream at a location where the stream has a Reynolds number of at least about 2,200. In such embodiments, the talc can be in the form of an aqueous dispersion. In other embodiments, the introduction of talc can be during the formation of a white water stream.

In various embodiments of the present invention, the talc can be contacted with an aqueous stream within about 10 minutes, about 5 minutes or about 1 minute after a high shear event. In other embodiments, the talc can be contacted with an aqueous stream after a high shear event when the average size of colloidal particles formed by the high shear event is less than about 1 micron or less than about 0.5 micron. In various embodiments of the invention, any talc material is suitable for use. The talc can be modified or not, have a variety of particle sizes, and can be from any suitable mine source. Further, in various embodiments, the talc can have a median particle size that ranges from about 2 microns to about 5 microns.

In further embodiments of the present invention, the aqueous stream, the re-circulating water stream, or the white water stream can contain a low amount of solids. For example, the stream can contain less than about 2 wt % solids, less than about 0.5 wt % solids or in other embodiments can contain from about 2 wt % to about 0.01 wt % solids.

In some embodiments of the present invention, from about 1 to about 100 pounds of talc are contacted with the aqueous stream, the re-circulating water stream or the white water stream for about each ton of solids in a fiber-containing pulp of the process.

In other embodiments of the present invention, the various processes include, after contacting talc with the aqueous stream, the re-circulating water stream or the white water stream, circulating the stream to another portion of the paper making process. For example, the stream can be circulated to at least one of a pulper, a thickstock, a thinstock, a dilution process, a shower, storage, washer, thickener, blending, or a digestor.

These and other needs are addressed by the various embodiments and configurations of the present invention. This disclosure relates generally to a process for controlling and/or inhibiting depositing of depositional materials in a papermaking process. More particularly, this disclosure is to a process comprising the use of talc for controlling and/or inhibiting the depositing of depositional materials on papermaking machinery and/or within a wet-wet formed in a papermaking process.

These and other advantages will be apparent from the disclosure of the invention(s) contained herein.

As used herein, the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The preceding is a simplified summary of the invention to provide an understanding of some aspects of the invention. This summary is neither an extensive nor exhaustive overview of the invention and its various embodiments. It is intended neither to identify key or critical elements of the invention nor to delineate the scope of the invention but to present selected concepts of the invention in a simplified form as an introduction to the more detailed description presented below. As will be appreciated, other embodiments of the invention are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present invention(s). These drawings, together with the description, explain the principles of the invention(s). The drawings simply illustrate preferred and alternative examples of how the invention(s) can be made and used and are not to be construed as limiting the invention(s) to only the illustrated and described examples.

Further features and advantages will become apparent from the following, more detailed, description of the various embodiments of the invention(s), as illustrated by the drawings referenced below.

FIG. 1 depicts a paper making process according to an embodiment of the present invention.

DETAILED DESCRIPTION OF THE INVENTION

Process conditions in the pulping process of the paper making industry have changed in relation to pitch and stickies control, allowing for increased levels of hydrophobic contaminants much closer to the high speed, high shear paper making process. Increasing concerns to control yield and energy losses have resulted in mills conserving fresh water usage. This has resulted in increasing contaminant concentrations in all of the mill process systems. The concentration levels dictate how efficiently certain parts of the process perform economically and productively. Higher concentrations of hydrophobic contaminants that build up in the pulp and white water system are detrimental and create conditions of loss and inefficiency. Process equipment is designed to work very efficiently with hydrophilic water-based systems and pulp conditions. At critical levels of hydrophobic contaminants, process upsets occur, changing the equilibrium balance towards non-Newtonian conditions, resulting in adverse rheological events leading to quality and productivity loss.

Retention aids and coagulants have traditionally been used in the paper industry to control fines and filler retention, but also as importantly to control pitch, stickies, and coating contaminants Like hydrocarbon retention polymers, talc also retains these contaminants in the same manner that a pressure sensitive adhesive tape is laminated to a silicone release liner. The critical difference between talc and traditional retention aids and coagulants is that talc attaches to the low surface tension hydrophobic surface of the contaminants, whereas the other materials use charge to attach to anionic sites. The reactivity of both talc and retention aids and coagulants is very rapid, however the end result is the exact opposite. Talc adsorbs the hydrophobic portion of the contaminant, and thus, the anionic portion of the contaminants will be away from the talc and beneficially in the water phase. With retention aids and coagulants, the anionic sites are attached to the hydrocarbon chain and the hydrophobic sites are exposed to the water phase. These hydrophobic complexes behave like oil-in-water emulsions under shear, creating poor and unpredictable rheology for papermaking, as well as poor fiber to fiber contact. Retention of these complexes becomes very difficult in White Water circulation loops due to the higher level of very active fatty acids in these areas. On the wire, they behave like micro oil droplets and leave behind pinholes and defects, as the sheet is released from the various surfaces in the wet end. Fatty acids are the most difficult component to retain and they lower pulp surface tension the most of all extractives, making it more difficult to remove from hydrophobic surfaces.

It has been found that the highest concentration of fatty acids and extractives, on a solids basis, typically occurs in high shear processes such as refinging, thickening, screw presses, and the shear forces experienced in the White Water and Save-all dilution streams and loops and through each pump. These now lower quality streams (because they are lower in surface tension and may adhere to low surface energy fabrics or surfaces) come in contact with several pulp components on the way back to the head box: Thick stock, Broke, Coated Broke, Save-all Sweetener, etc. As they contact these new pulp streams, they change the interaction of the various hydrophobic pitch and waste plastic films present. The change that occurs is similar to the softening of plastics for the manufacture of extruded materials and adhesives. High concentration of lubricants (i.e. fatty acids and their salts) and high strength of the lubricant (e.g., calcium stearate is highly effective) elevates the swellability of the pitch particles and waste plastic films, and how far and fast they degenerate into soft, flexible, extrudable (the smaller the fine screen the greater the shear stress) and tacky adhesives.

The use of talc in accordance with the present invention improves the efficiency and productivity of papermaking processes. The reduction of system hydrophobicity by shielding hydrophobic contaminants on the surface of talc allows anionic sites to be readily retained onto other system particles (e.g., cationic polymers and coagulants) with a slight cationic charge. At detrimental concentrations of hydrophobic surface active materials, Newtonian water solutions can experience non-Newtonian behavior, which creates numerous unpredictable efficiency and productivity losses. Production issues arise and create serious and costly losses. By adding talc at favorable locations in the papermaking process in accordance with the present invention, the system increases rapidly in surface tension and inverts towards more favorable hydrophilic, hydrogen bonding, papermaking conditions. The wet web is now easily lifted away from the hydrophobic designed wire and press fabrics, center rolls, dryer cans and clothing, calendar stacks, etc., at very significant rates (sometimes>1800 mpm)

Due to the improved surface tension of the wet web and easy release from low surface energy hydrophobic surfaces, Numerous benefits can be achieved by the present invention, including:

- Reduction in surface defects (holes, pinholes, light spots, etc.);
- Polymer retention efficiency increase when contaminants with hydrophobic surfaces are reduced in concentration;
- Polymer programs can be reduced, which increases hydrophobicity even more;
- Hydrogen bonding, important to sheet strength development, increases in a hydrophilic system improving tensile, modulus of elasticity, and burst;
- Surface tension increases, reducing the tendency for deposition and reducing the tension of wet web release from the wires, felts, mineral center rolls, and steel dryer cans; This is measured as improved minutes of uptime, and results in significant opportunities to improve productivity and efficiency of the various processes.

The behavior of talc in paper mill process water and the inherent benefits of talc have not been well understood in the paper industry. It has been demonstrated chemically that talc has a very low Gibb's Free Energy, and thus, when added to a very active, and negative Gibb's Free Energy solution, talc readily reacts with hydrophobic surfaces present. In pulp and paper making, the concentrations of hydrophobic extractive contaminants elevates in 'closed' systems and in systems that have numerous plastic and hydrophobic coating films present. This invention is particularly advantageous in such systems and can control the hydrophobic events in an efficient and controlled environment, in close proximity to where active plastic polymers and extractives have been recently 'activated' through certain conditions of pH, temperature, shear and particle friction stress (e.g., Head Box jet, high speed wire, high drainage and vacuums, pressing, calendaring, etc.). By adding talc to recently sheared water exiting the wet end of a paper machine through hydrophobic polymeric wire(s) or clothing fabrics, for example, which will concentrate extractives, fillers and fines in the collections tanks below the paper machine Save-alls, the present invention can increase the final extractive retention, reduce their generation in the process, increase the capture rate of hydrophobic materials that can be collected and collect extractives permanently onto the hydrophobic surface of the talc. Thus, the invention shields the 'oil' from the water phase. As a result, the materials come together much faster on the wire and through the presses, leaving much less stress on the wet web. Porosity, pinholes, holes, light spots, draws, lint all decrease. Strength, burst, formation, smoothness all (improve) increase. The addition of talc to the Save-all is efficient due to the predominant highly active, negative Gibb's Free energy particles available, but most importantly, due to the use of the process waters and pulp that are processed through this system.

Clear and Cloudy White Water streams are created by the Save-all that are lower in consistency than the incoming feed stream and much lower in consistency than the outlet thick stock matte. Recent analysis of these pulp streams show much higher levels of surface concentration of both extractives and free fatty acids on the remaining particles. It has been determined that fines and small fines can have between 10-70% surface coverage of hydrophobic extractives. The present invention ties up the hydrophobic extractives and leaves anionic surfaces of fibers with reduced concentrations of extractives and hydrophobic additives, more friendly to the hydrophilicly, Newtonian designed paper making process. In addition, adsorbing hydrophobic extractives onto the talc surface while not interfering with the anionic charge of the contaminants creates a particle that is easier to retain in the sheet through hydrogen bonding with the fiber phase or with the use of standard paper making cationic polymers. Such retention results in the contaminants being discreetly removed from the system in the finished sheet and prevents potential re-agglomeration in the recirculating process water.

Adding the streams of White Water (Clear and Cloudy) leaving the Save-all to the feed of the Save-all improves the quality of these streams that are then re-used to dilute numerous incoming stock or broke applications (coated & un-coated). By practice of the present invention, numerous process streams can be improved by shielding the hydrophobic portions of the contaminants by hydrophobic adsorption, thereby making the system more effectively hydrophilic. The equipment is the wet end in pulp and paper manufacturing is highly engineered and precise to manage Newtonian rheological papermaking events Embodiments of the present invention are directed to paper making processes having reduced depositional material. More specifically, processes of the present invention include the use or addition of talc for the reduction of depositional materials in paper making processes. The talc is introduced strategically at locations within the paper making process to achieve surprisingly high reductions in depositional materials. In particular, talc is introduced into the paper making process at locations having relatively low amounts of pulp, such as in white water streams, as described below in detail. Before discussing the present invention in more detail and to provide context for discussion of the invention, paper making processes are first generally described.

Paper making processes (including processes for making paper, paperboard, cardboard, newsprint, tissue, board, wallpaper, drywall paper, packaging, etc.) generally include the steps of (i) forming a fiber-containing pulp; (ii) forming an aqueous steam and a wet fiber-containing web; (iii) drying the wet fiber-containing web; and (iv) recycling the aqueous stream. With reference to FIG. 1, such a process is illustrated.

Fiber-containing pulps useful in the present invention are typically aqueous dispersions having a fiber content. Such dispersion can have a fiber content of at least about 1 wt % fiber, at least about 2 wt % fiber, at least about 3 wt % fiber, or at least about 4 wt % fiber. Such aqueous dispersions can also typically have a fiber content of less than about 5 wt % fiber, less than about 6 wt % fiber, less than about 7 wt % fiber, less than about 8 wt % fiber, less than about 9 wt % fiber, or less than about 10 wt % fiber.

The fibers in fiber-containing pulps can comprise wood and/or non-wood fibers. For example, the fiber source can be a wood product, a vegetable product, a mineral source, and/or man-made product. Furthermore, the fiber source can be wood obtained as harvested naturally grown wood, from a tree farm and/or a recycled wood. Alternatively, the fiber source can be paper, cardboard and/or textile product. The fibers obtained from the fiber source can be wood fibers, cellulosic fibers and/or non-wood fibers. Examples of non-wood fibers include without limitation fibers obtained from straw, grasses, mitsumata, mulberry, flax, cotton, jute, sisal, manila, hemp, corn stalks, sugarcane, and bamboo.

The pulp forming process can comprise one of a mechanical pulping process, a chemical pulping process or a combined mechanical and chemical pulping process. The mechanical pulping process can comprise one of a fine, course or bleached ground wood process. The chemical pulping processes can comprise one of unbleached sulfite, bleached sulfite, bleached sulfate, unbleached sulfate, and soda process. The combined mechanical and chemical pulping process can comprise a chemical "cooking" followed by mechanical treatment.

The pulp forming process releases depositional (alternatively referred to as depositable) materials contained with the fiber-containing source, which includes materials known in the art as "pitch" and "stickies". The depositional materials can comprise hydrophobic organic materials contained within the fiber-containing source. For example, the sulfite chemical process comprises an acid bisulfite solution to soften the fiber-containing material (such as, wood chips) and remove the depositional materials from the fiber-containing material. When the fiber source is from a naturally occurring source such as wood, the depositional materials can comprise one or more of oils, waxes, resins and fatty acid-containing materials. Non-limiting examples of wood oils are beta-sitosterol, tall oil, fatty alcohols, sterols, steryl esters, and mono-, bi- and tri-cyclic terpenes. Non-limiting examples of terpenes are: limonene, terpinolene, alpha-pinene, beta-pinene, delta-3 carene, sabinene, sesquiterpens, longifolene, caryophyllene, and delta-cadineene. While not wanting to be limited by example, wood waxes and resins can include without limitation: abietic acid, neoabietic acid, dihydroabeietic acid, palustric acid, levopimaric acid, pimaric acid and isopimaric acid. Such depositional materials, individually and/or combined, are commonly referred to within the art as pitch.

Wood from different types of trees can contain from about 0.1 wt % to about 10 wt % of depositional materials (i.e., pitch). Typically, at least some, if not most, of depositional materials comprise fatty acid-containing materials. Fatty acid-containing material is typically present in the wood as a non-ionic triglyceride ester. The triglyceride ester comprises a plurality of fatty acids and glycerol. The triglyceride can be hydrolyzed during the pulping process to form free glycerol and one or more free fatty acids and/or ionized free fatty acids. Ionized fatty acids are commonly produced in the Kraft process for forming the aqueous fiber-containing pulp. The Kraft process comprises caustic (that is, a solution having a pH greater than about pH 7, preferably a pH from about pH 9 to about pH 13) sulfite solution for forming the aqueous fiber-containing pulp.

The fatty acids (in free and/or ionized form) can comprise one or more of saturated and unsaturated carboxylic acids having a carbon chain length from about 4 to about 35 or from about 12 to about 24. The fatty acids may be straight-chained or branched carboxylic acids. Typically, straight-chained carboxylic acids are more common then branched. The soft woods commonly have a greater resin and/or fatty acid content than hard woods. Non-limiting examples of saturated fatty acids are butanoic, pentanoic, hexanoic, octanoic, nonanoic, decanoic, dodecaoic, tetradecanoic, hexadeconoic, heptadecanoic, octadecanoic, eicosanoic, docosanic, tetracosanoic, hexacosanoic, heptacosanoic, octacosanoic, tracontanoic, dotricontanoic, tritricontanoic, tetratricontanoic, and pentatricontanoic acids. While not wanting to be limited by example, examples of unsaturated fatty acids comprise cis-4-decenoic, cis-9decenoic, cis-5-lauroleic, cis-4-dedecenoic, cis-9-tetradecenoic, cise-5-tetradecenoic, cis-4-tetradecenoic, cis-9-hexadecenoic, cis-6-hexadecenoic, cis-6-octadecenoic, cis-9-octadecenoic, cis-9-octadecenoic, trans-9-octdecenoic, cis-11-octdecenoic, cis-9-eicosenoic, cis-11-eicosenic, cis-11-docosenoic, cis-13-docosenoic, cis-15-tetracosenoic, 9,12-octadecadienoic, 6,9,12-octadecatrienoic, 8,11,14-eicosatrienoic, 5,8,11,14-eicosatetraenoic, 7,10,13,16-docosatetrenoic, 9,12,15-octadecatrienoic, 6,9,12,15-octadecatetraenoic, 8,11,14,17-eicosatetrenoic, 7,10,13,16,19-docosapentaenoic, 4,710,13, 16-19-docosahexaenoic, 6,9,12,15,18,21-tetracoenoic, and 5,8,11-eicostrienoic acids. Non-limiting examples of branched chain fatty acids are cis-11-methyl-dodecenoic acid, 10-methyl octadecanoic acid, 17-methyl-6-octdecenoic acid, pristanic acid, phytanic acid, β-retinoic acid, and 17-methyl-7-octdecenoic acid.

When the fiber source comprises recycled materials, the depositional materials can comprise, without limitation, in addition to those indicated above, one or more of polyethylenes, polystyrenes, styrene-butadiene copolymers, styrene copolymers, polyamides, polyacrylates and polyproplyenes. Furthermore, the aqueous fiber-containing pulp can comprise one or more processing additives comprising, without limitation, resin acids, resin acid derivatives, fatty acids, fatty acid derivatives, hydrocarbons, alkyl ketene dimmers, epichlorohydrin, starch, silicones, polymeric materials, polymeric oligomers, thermoplastic adhesives, thermosetting adhesives, polyvinyl acetate, pressure-sensitive adhesives, sizing agents, and wet-strength resins.

At least most, if not all, depositional materials are substantially insoluble in aqueous fiber-containing pulps. The solubility of depositional materials in aqueous fiber-containing pulps can be affected, for example, by the aqueous fiber-containing pulp pH, temperature, shear, agitation and/or turbulence.

In some paper making processes, the depositional material can be in the pulp in the form of a colloid. As used herein, the term colloid means an emulsion and/or a dispersion of the depositional material. Alternatively, some of the depositional material can be agglomerated or suspended in the pulp.

While not wanting to be limited by example, changes in one or more of the physical and/or chemical conditions of the aqueous fiber-containing pulp can affect the stability of the depositional material, whether in a colloid or not. For example, changes in the aqueous fiber-containing pulp pH, temperature, shear, agitation and turbulence can destabilize depositional material and cause of the depositional material to form an aggregate and/or phase separate. In some instances, the aggregated and/or phase separated depositional material can include fibers and other materials (such as, other insoluble organic and inorganic material contained within the aqueous fiber-containing pulp).

Depositional material can aggregate and/or phase separate at any time during any process step of paper making processes. However, depositional material typically aggregates during formation of a wet fiber-containing web. For example, fibers contained within an aqueous fiber-containing pulp are separated from the aqueous fiber-containing pulp to form an aqueous stream and a wet fiber-containing web. More specifically, the aqueous fiber-containing pulp can be pressurized by a pump and formed into a narrow stream prior to contact with a porous belt (typically a woven or formed sieve-like fabric made of wire or polymer). The porous belt retains substantially most of the fibers contained within the aqueous fiber-containing pulp. The retained fibers form the wet fiber-containing web. The water and material passing through the porous belt, forms an aqueous stream. Such an aqueous stream is commonly referred to within the papermaking art as "white water" or recycle-water. The aqueous stream comprises water, fibers not retained by the porous belt and a first part of the depositional material contained within the aqueous fiber-containing pulp. The porous belt retains substantially most of the long fibers contained within the aqueous fiber-containing pulp and a second part of the depositional material contained with the aqueous fiber-containing pulp. As used herein, the term long fiber means a fiber length greater than about 2 mm.

The aqueous stream or solution has a median length fiber length of less than about 2 mm. Stated another way, the aqueous stream or solution contains more fibers having a length of about 2 mm or less than fibers having a length of about 2 mm or more. The aqueous stream or solution has a long fiber content less than the long fiber content of the aqueous fiber-containing pulp, since the porous belt retains most of the long fibers. When at least some of the depositional material is deposited during the formation of the wet fiber-containing web, the first part of the depositional material is less than the amount of depositional material contained within the aqueous stream. When little, if any, of the depositional material is deposited during the formation of the wet fiber-containing web, the first part of the depositional material is about equal to the amount of depositional material contained within the aqueous stream. Moreover, the depositional material deposited during the formation of the wet fiber-containing web comprises the second part of the depositional material retained by one or both of the papermaking machinery and/or wet fiber-containing web. As used herein, the aqueous stream or solution can refer to waters comprising one or more of white water, excess white water, white water combined with sweetener fiber, save-all water, cloudy white water, clear white water, gravity strainer permeate, gravity strainer retentate, shower water, stock dilution water, returned treated waste water and effluent treated water.

The phase separation of the fibers from the aqueous fiber-containing pulp can cause the depositional material to separate from the aqueous stream to form an aggregated depositional material. The aggregated depositional material can be deposited on a variety of pieces of equipment, including the continuous porous belt, the pump pressurizing the aqueous fiber-containing stream, the equipment forming the narrow stream, and the wet fiber-containing web.

The aggregated depositional material deposited on the porous belt and papermaking machinery can cause the machinery to fail and/or breakdown. Furthermore, the deposited aggregated depositional material can be one or both of transferred to and/or deposited with the fibers on the porous belt.

The wet fiber-containing web is dried to form a final paper product, for example referring to step 103 in FIG. 1. The inclusion of aggregated depositional material within the wet fiber containing web impacts the quality of the wet fiber-containing web and final paper product. Paper products containing the aggregated deposited material can be difficult to process due to at least the sticky nature of the aggregated depositional material deposit.

Referring, for example, to step 104 in FIG. 1, the aqueous stream is recycled to the step of forming the aqueous fiber-containing pulp stage (step 101). The aqueous stream is substantially depleted of long fibers and contains at least some, if not substantially most, of the depositional material. The depositional material can comprise one or both of colloid and aggregated depositional material.

Prior to recycling the aqueous stream to the step of forming the aqueous fiber-containing pulp stage, the aqueous stream can be combined with sweetener fibers, processed, and/or retained by one or more of the save-all, gravity strainer, and diluted with stock dilution water, flotation, centrifuge, and cyclone separator.

It can be appreciated that recycling the aqueous stream to the step of forming an aqueous fiber-containing pulp can increase the depositional material content of the aqueous fiber-containing pulp. One or more of the tendency and extent to deposit the depositional material is substantially increased as the depositional material concentration in the aqueous fiber-containing pulp increases.

Current practice for decreasing the depositional material content with the aqueous fiber-containing pulp within the papermaking industry is to add alum to the aqueous fiber-containing pulp. The alum binds to the depositional material and to the fibers within the aqueous fiber-containing pulp to form an alum-containing aggregate. The alum-containing aggregate is deposited with the fibers to form the wet fiber-containing web. The addition of alum to the aqueous fiber-containing pulp has had limited success in substantially reducing the deposition of depositional material on the papermaking machinery and in eliminating the problems associated with depositional material within the wet fiber-containing web. Moreover, the increased utilization of recycled fiber-containing sources within the papermaking industry has substantially increased the depositional material content of the aqueous fiber-containing pulp. In addition to alum, talc has been added to the aqueous fiber-containing pulp. Like alum, the addition of talc to the aqueous fiber-containing pulp has had limited success in substantially reducing the deposition of depositional material on the papermaking machinery and in substantially eliminating the problems associated with depositional material within the wet fiber-containing web.

Turning now to various general aspects of the present invention, embodiments of the present invention can include the addition of talc to an aqueous stream to form a depositional material-loaded talc and a depositional material-depleted aqueous stream. Typically, the aqueous stream is selected so that it has a lower fiber content than the fiber content of a fiber-containing pulp While not wanting to be limited by any theory, it is believed that contacting talc with an aqueous stream having a lower fiber content than the aqueous fiber-containing pulp allows for the more efficient and/or more effective formation of talc loaded with depositional material. The talc can interact and load the depositional material more easily in the lower fiber content aqueous stream than in the higher content aqueous fiber-content pulp. Furthermore, contacting talc with an aqueous stream under high shear and/or more turbulent conditions increases the rate of contact of the talc with the depositional material. The increased rate of contact increases the rate of formation of the depositional material-loaded talc and depositional-depleted aqueous stream.

Another general aspect of the present invention is that talc can be introduced to aqueous streams at locations that have an elevated depositional index. A depositional index is a measure of a stream's ability to produce depositional material. Therefore, by introducing talc at a location in a stream having an elevated depositional index, talc is introduced where it can have a proportionately large effect of reducing or preventing depositional materials. A depositional index can be one or more of the concentration of extractables, free fatty acid, and/or dry ash or the ratio of free fatty acid to extractables. The greater the depositional index the greater the probability of the depositional material being deposited within the papermaking process. The level of the extractables, free fatty acid, dry ash and free fatty acid to extractables ratio are preferably measured as dry solids content of the aqueous stream. As used herein extractables means materials that can be extracted from the aqueous stream using an organic solvent, such as dichloromethane, as an extracting agent. As used herein dry ash means the materials remaining as an ash after the aqueous solution has been dried and fired in an oxidizing atmosphere to a temperature of at least about 400 degrees Celsius.

Reference to an elevated depositional index can mean a depositional index that is greater than an average of depositional indexes for various streams within a papermaking process. For example, one or more depositional indices can be determined empirically for a given papermaking process by sampling multiple locations within a papermaking process and taking appropriate measurements. Such measurements can then be averaged and any locations having a depositional index higher than the average are candidates for introduction of talc at that location. In other embodiments, the talc can be added to an aqueous stream having a depositional index greater than an upper quartile of depositional indices for the various streams within the papermaking process. In still further embodiments, talc can be added to an aqueous stream having a depositional index at least greater than the upper 80%, the upper 85%, the upper 90%, the upper 95%, of depositional indexes for the various streams within the papermaking process. In another embodiment, talc can be added to an aqueous stream in the papermaking process having the greatest depositional index of those evaluated.

While not wanting to be limited by any theory, it is believed that contacting talc with an aqueous stream having an elevated depositional index allows for more efficient and/or more effective formation of talc loaded with the depositional material. The talc can interact with and load the depositional material where the depositional material is most active and most present within the papermaking process 100. Furthermore, contacting the talc with an aqueous stream having an elevated depositional index allows for the talc to remove a greater quantity of the depositional material where the depositional material is present in the highest concentrations within the papermaking process 100.

A first embodiment of the present invention is a process for reducing depositional material in a paper making process that includes contacting talc with an aqueous stream in a paper making process, wherein the aqueous stream has a low long fiber content.

Talc is a phyllosilicate mineral having the formula $Mg_3Si_4O_{10}(OH)_2$. Any talc is suitable for use in the present invention. The talc can be from any talc-containing mineral source or from any mine. The talc can be produced by any talc refining process or by any manufacturing process. While not wanting to be limited by any example, the talc may be of any size and/or shape and may or may not be chemically and/or physically modified. The talc will typically be in the form of fine particles. The fine particles can have an average particle size of less than about 50 microns (micrometers), preferably less than about 10 microns and more preferably less than about 5 microns. In a preferred embodiment, the median particle size of talc is from about 2 to about 5 microns. In another embodiment, the talc particles have an average equivalent spherical diameter from about 20 to about 0.4 microns, preferably from about 15 to about 1 microns, more preferably from about 10 to about 2 microns, even more preferably from about 8 to about 3 microns. Alternatively, the talc can be in the form of an aqueous dispersion comprising fine particles of the talc. For example, an aqueous dispersion can be prepared by combining talc and water in a high shear mixer.

Depositional material is one or more of an oil, a wax, a resin, and a polymeric material. The oil, wax resin and/or polymeric material can be a natural and/or synthetic oil, wax, resin and/or polymeric material. The natural oil, resin and/or wax can be derived from a plant (such as, wood) or an animal. The polymeric material can be a functional polymeric material added during the paper making process and/or a polymeric material entering the paper making process as a contaminant. Typically, the depositional material comprises a fatty acid-containing material.

In this embodiment of the invention, the talc is contacted with the aqueous stream at a time and location in the paper making process when the aqueous stream has a low long fiber content, for example after separation of a wet fiber-containing web. More generally, reference to having a low long fiber content refers to a time and location in the paper making process in which the long fiber content of a stream is lower than at a prior time and location in the process. In this manner, the added talc has a significantly greater opportunity to interact with the depositional material than when there is a high long fiber content in the aqueous stream. In various embodiments, at the time of contacting the talc with the aqueous stream, the aqueous stream contains less than about 5 wt % solids, less than about 4 wt % solids, less than about 3 wt % solids, less than about 2 wt % solids, less than about 1 wt % solids, less than about 0.5 wt % solids, less than about 0.3 wt % solids, less than 0.2 wt % solids, less than 0.1 wt % solids, less than 0.09 wt % solids, less than 0.08 wt %, less than 0.07 wt % solids, less than 0.06 wt % solids, less than 0.05 wt % solids, less than 0.04 wt % solids, less than 0.03 wt % solids, less than 0.02 wt % solids, or less than 0.01 wt % solids. In one preferred embodiment, the aqueous solution has from about 2 wt % solids to about 0.01 wt % solids.

As used herein solids refers to fiber and substantially most, if not all, of the soluble and insoluble materials contained within the aqueous stream. More precisely, the solids content of the aqueous stream means the weight percentage of the aqueous stream remaining after a given amount of the aqueous stream has been dried to a constant weight at about 105 degrees Celsius.

The contacting of the talc with the aqueous stream to form the depositional material-loaded talc and the depositional material-depleted aqueous stream substantially reduces the depositional material content of the aqueous stream. The substantially reduced levels of the depositional material content of the aqueous stream further substantially reduces the depositional material content of the aqueous fiber-containing pulp when the aqueous stream is recycled to the fiber-containing pulp formation step (step 101). That is, reducing the depositional material content of the aqueous stream after the formation of the wet fiber-containing web and prior to recycle of deposition material-depleted aqueous stream to the forming of the aqueous fiber-containing pulp substantially reduces the depositional material within the papermaking process 100 compared to contacting talc with the aqueous fiber-containing pulp and/or other stream within the pulp making process 100 other than the aqueous stream. That is, the accumulation of depositional material within the papermaking process 100 is substantially reduced by contacting talc with the aqueous stream after the forming of the wet fiber-containing web and prior to recycle of the depositional material-depleted aqueous stream to forming of the aqueous fiber-containing pulp process. Furthermore, the reduction in the accumulation of the depositional material within the papermaking process 100 reduces the level and extent of depositional material deposited on the papermaking machinery and within the wet fiber-containing web.

The amount of talc that is contacted with the aqueous stream is sufficient to achieve a desired reduction in depositional material. For example, the amount of talc added to the aqueous stream can be from about 1 lbs, from about 5 lbs, from about 10 lbs, from about 15 lbs, from about 20 lbs, from about 25 lbs, from about 35 lbs, from about 40 lbs, or from about 45 lbs for each ton of solids in the fiber-containing pulp to about 50 lbs, to about 60 lbs, to about 70 lbs, to about 80 lbs, to about 90 lbs, or to about 100 lbs for each ton of solids in the aqueous stream. In a preferred embodiment, from about 20 to about 25 lbs of talc is added to the aqueous stream for each ton of solid contained in the fiber-containing pulp.

The aqueous stream in this embodiment can be formed by separating wood pulp from a wood pulp-containing aqueous stream. The separation can be accomplished by use of a pulp-retention device in either a physical separation process or a flotation separation process. A non-limiting example of a physical separation process is contacting the wood pulp-containing aqueous stream with a wire screen. Non-limiting examples of flotation processes are flotation by entraining of air with or without the addition of chemical additives (non-limiting examples of such air flotation processes are air flotation equipment manufactured and marketed by Krofta Technologies, LLC and Poseidon, Inc.). The aqueous stream can be one or more of a white water, excess white water, white water combined with sweetener fiber, save-all water, cloudy white water, clear white water, gravity strainer permeate, gravity strainer retentate, shower water, stock dilution water, returned treated waste and effluent treated water.

The step of contacting talc with an aqueous stream can form a depositional material-loaded talc and depositional material-depleted aqueous stream, thereby achieving a desired goal of the process. Preferably, the amount of depositional material that is removed from the stream by associating with the talc is sufficient to reduce the amount of depositional material in the stream by at least about 1 wt %, at least about 2 wt %, at least about 3 wt %, at least about 4 wt %, at least about 5 wt %, at least about 6 wt %, at least about 7 wt %, at least about 8 wt %, at least about 9 wt %, at least about 10 wt %, at least about 20 wt %, at least about 30 wt %, at least about 40 wt %, at least about 50 wt %, at least about 60 wt %, at least about 70 wt %, at least about 80 wt %, or at least about 90 wt %.

In this embodiment, the talc can be contacted with the aqueous stream in any manner suitable for bringing the talc into proximity with depositional material in the stream. For example, the talc can be contacted with an aqueous stream that is quiescent (i.e., that has a quiescent surface), particularly when the talc is in the form of fine particles. During quiescent conditions at least some of the colloidal depositional material can coalesce and form a depositional material-containing film on the aqueous stream surface. More particularly, the talc can be contacted with the quiescent stream in any manner and specifically, can be contacted on the depositional material-containing film on the surface of the stream.

The talc can also be contacted with the aqueous stream during one or more of a high shear and/or more turbulent process. While not wanting to be bound by any theory, it is believed that during a high shear and/or turbulent process the depositional material forms a colloid having a greater number of colloidal particles than in a lower shear and/or less turbulent process. The probability of the talc encountering a depositional material colloidal particle to form the depositional material-loaded talc is greater in the shear aqueous solution under high shear than under low shear conditions.

In one preferred embodiment, the talc is contacted with the aqueous stream substantially immediately after the formation of the aqueous stream. That is, the talc is contacted with the aqueous stream substantially during the formation of the wet fiber-containing web and the aqueous stream. In a more preferred embodiment, the talc is contacted with the aqueous stream after the formation of the wet fiber-containing web while the aqueous stream is substantially turbulent and/or under a high shear condition. More particularly, the talc can be contacted with an aqueous stream that has a Reynolds number of at least about 1, at least about 1000, at least about 2,200, at least about 10,000, at least about 50,000, at least about 100,000 or higher. In these embodiments, the talc can be in the form of an aqueous dispersion.

In a further embodiment, the talc is contacted with the aqueous stream within a certain time after the creation or initiation of a high shear event (e.g., an event causing increased turbulence), for example, within a certain time after a physical separation process, such as the use of a wire screen. More particularly, talc can be added downstream after a high shear event at a point at which it takes the stream the certain amount of time to travel from the high shear event. In this embodiment, talc can be added within about 10 minutes after the creation or initiation of a high shear event or increased turbulence, within about 9.5 minutes, within about 9 minutes, within about 8.5 minutes, within about 8 minutes, within about 7.5 minutes, within about 7 minutes, within about 6.5 minutes, within about 6 minutes, within about 5.5 minutes, within about 5 minutes, within about 4.75 minutes, within about 4.5 minutes, within about 4.25 minutes, within about 4 minutes, within about 3.75 minutes, within about 3.5 minutes, within about 3.25 minutes, within about 3 minutes, within about 2.75 minutes, within about 2.5 minutes, within about 2.25 minutes, within about 2 minutes, within about 1.75 minutes, within about 1.5 minutes, within about 1.25 minutes, within about 1 minute, within about 45 seconds, within about 30 seconds, within about 15 seconds, within about 14 seconds, within about 13 seconds, within about 12 seconds, within about 11 seconds, within about 10 seconds, within about 9 seconds, within about 8 seconds, within about 7 seconds, within about 6 seconds, within about 5 seconds, within about 4 seconds, within about 3 seconds, within about 2 seconds, within about 1 second.

In a further embodiment, the talc is contacted with the aqueous stream after the creation or initiation of a high shear event or increased turbulence while the size of colloidal particles is less than a certain size. As discussed above, during a high shear and/or turbulent process, the depositional material can form a colloid. Over time, the colloidal particles will aggregate forming larger particle sizes. In this embodiment, talc is contacted with the aqueous stream after the creation or initiation of a high shear event or increased turbulence while the average size of colloidal particles is less than about 1 micron, less than about 0.9 micron, less than about 0.8 micron, less than about 0.7 micron, less than about 0.6 micron, less than about 0.5 micron, less than about 0.4 micron, less than about 0.3 micron, less than about 0.2 micron, less than about 0.1 micron, less than about 0.05 micron, less than about 0.01 micron, less than about 0.005 micron, less than about 0.001 micron.

In another embodiment, the talc is contacted with the aqueous stream in one of laminar or non-laminar flow, and preferably the aqueous stream is in non-laminar flow. While not wanting to be bound by any theory, a liquid having a Reynolds number of less than about 2,200 is considered to be in laminar flow and a liquid having a Reynolds number of about 2,200 or more is considered to be in non-laminar flow.

In this embodiment and other processes of the present invention, after the step of contacting talc with an aqueous stream, the amount of depositional material in the stream is reduced. For example, the amount of depositional material, preferably as the free fatty acid and/or extractables, in the aqueous stream, after the step of contacting, can be less than about 10 ppm, less than about 50 ppm, less than about 100 ppm, less than about 500 ppm, less than about 1,000 ppm, less than about 5,000 ppm, or less than about 10,000 ppm. In other embodiments, the contacting of the talc with the aqueous stream reduces the depositional index of the aqueous stream by at least about 5%, at least about 10%, at least about 15%, at least about 20%, at least about 30%, at least about 40%, at least about 50%, at least about 60%, at least about 70%, at least about 80%, at least about 90%, or at least about 95%.

In another embodiment and other processes of the present invention, after the step of contacting the talc with an aqueous stream having a low long fiber content, population density and size of one or both holes and spots within the produced paper is reduced. The term "population density" refers to the number of holes or spots within the produced paper per reel (while not wanting to be limited by example a reel typically comprises about 200,000 linear feet of paper) produced. The term "hole" means a void within the paper produced, that is, a void traversing the entire thickness of the produced paper. The term "spot" means a significant difference in one or both of the reflectivity and brightness of a given surface area of the produced paper compared to reflective and brightness values for a standard paper product. Hole and spot sizes are typically classified as small, medium, large, and extra large. Small refers to holes or spots from about 0.5 mm to about 2.5 mm, medium refers to holes or spots from about 2.5 mm to about 12 mm, large refers to holes or spots from about 12 mm to about 30 mm, and extra-large refers to holes or spots more than about 30 mm. Preferably, the population density of one or more of the small, medium, large and extra-large size of one or both of the holes and spots within the produced paper is reduced by at least about 10%, at least about 20%, at least about 30%, at least about 40%, at least about 50%, at least about 60%, at least about 70%, at least about 80%, or at least about 90% after the step of contacting the talc in accordance with the present invention.

In another embodiment and other processes of the present invention, after the step of contacting the talc with an aqueous stream of the present invention, the paper produced has an increased tensile strength compared to paper produced with or without talc added in a conventional manner. More specifically, compared to paper produced by conventional processes, including talc additions at conventional locations in the papermaking process, paper produced by contacting the talc with an aqueous stream of the present invention has a tensile strength of at least about 5% greater, at least about 10% greater, at least about 15% greater, at least about 20% greater, at least about 25% greater, at least about 30% greater, at least about 40% greater, at least about 50% greater, at least about 60% greater, or at least about 75% greater than such conventionally produced materials.

In this embodiment and other processes of the present invention, after the step of contacting talc with an aqueous stream, the process can further include circulating the aqueous stream to other portions of the paper making process. For example, the aqueous stream can be circulated to either an aqueous stream in another portion of the paper making process having more long fibers than short fibers or to one having less long fibers than short fibers. Alternatively, the processes can include, after contacting the talc with the aqueous stream, circulating the aqueous stream to at least one or more of a pulper, a thickstock or thinstock dilution process, a shower, storage, blending (with other aqueous stream for water conservation and reuse), and a digestor of the paper making process.

As used herein, the term pulper means a mechanical and/or chemical unit for separating fibers from a fiber-containing source. As used herein, the term thickstock means solution containing from about 2 to about 10% solids. As used herein, the term thinstock means a solution containing less than about 2 wt % solids. As used herein, the term dilution process means adding water to from a less concentrated solution from a more concentrated solution. As used herein, the term shower means a water jet or spray to wash papermaking machinery or machinery components (such as, wire mesh, forming wires and press felts) and wet fiber-containing mat. As used herein, the term storage means any vessel used to store at least one of the aqueous stream, re-circulating stream or white water stream after being contacted with talc. Liquid being stored within the storage vessel may be agitated, circulated and/or held under quiescent conditions. As used herein, the term blending means combining one of the aqueous stream, re-circulating stream or white water stream after being contacted with the talc with another aqueous stream. The other aqueous stream may contain pulp and/or fillers or may be substantially free of any pulp and/or fillers.

A second embodiment of the present invention is a process for reducing depositional material in a paper making process. This process includes separating pulp from a pulp-containing stream to form a re-circulating stream and adding talc to the re-circulating water stream before introducing the re-circulating water stream to a stream having a pulp content higher than the pulp content of the re-circulating stream. In this manner, the addition of talc is effective in depleting depositional material from the re-circulating stream. Detailed aspects of this second embodiment of the present invention are as described above with respect to the first embodiment of the present invention.

A third embodiment of the present invention is a process for making paper products. The process includes contacting a wood-based fiber-containing material with water to form a woody fiber-containing stream and contacting the wood fiber-containing stream with a pulp-retention device to form a wet paper sheet and a white water. The process further includes drying the wet paper sheet to form a dry paper sheet. Furthermore, the process includes contacting the white water with talc to form a talc-containing white water and circulating at least a portion of the talc-containing white water to the contacting of the wood fiber-containing material with water step. Detailed aspects of this third embodiment of the present invention are as described above with respect to the first embodiment of the present invention.

EXAMPLES

The following examples are provided to illustrate certain embodiments of the invention and are not to be construed as limitations on the invention, as set forth in the appended claims. All parts and percentages are by weight unless otherwise specified.

Example 1

One liter process water samples were collected from the broke tank, save-all accepts (that is, the water entering the save-all), the save-all clear (that is, the clear filtrate from the save-all), save-all cloudy (that is, the cloudy filtrate from the save-all), broke chest, coated broke, blend chest, machine chest, white water tray, and head box of a papermaking circuit. Each sample was analyzed for extractive and fatty acid content.

The extractive content was determined by extracting a 160 gram aliquot of the water sample with dichloromethane. Each aliquot was extracted three times with dichloromethane. Each of the three extractions was conducted with 50 ml of dichloromethane. The three 50 ml dichloromethane extraction samples were combined and filtered to remove materials contained within the dichloromethane extractions that are insoluble within the dichloromethane. The dichloromethane was removed from the filtered dichloromethane by evaporatively removing the dichloromethane with a convection oven to form a dichloromethane residual. The mass of the dichloromethane residual (in mg) per mass of the aliquot (in kg) corresponds to the extractives level of the water sample (mg/kg also respectively corresponds to ppm). The fatty acid content was determined by GC-MS analysis of the extractives. Representative values of the fatty acid and extractable content for the process stream are summarized in Table I.

TABLE I

| Location | Free Fatty Acid (FFA) (mg FAA/kg sol'n) | Extractives (mg extractive/kg sol'n)* | Extractive: FFA Ratio |
|---|---|---|---|
| Save-all accepts | 8 | 500 | 63 |
| Save-all clear | 76 | 4,010 | 53 |
| Save-all cloudy | 150 | 2,200 | 15 |
| Broke chest | 14 | 240 | 17 |
| Coated broke | 42 | 1,305 | 31 |
| Blend chest | 5 | 200 | 40 |
| Machine chest | 6 | 1,000 | 167 |
| White water tray | 375 | 11,625 | 32 |
| Head box | 9 | 1,900 | 211 |

*The extractive levels are the average of duplicate analyses.

The locations for treating with talc are selected based on having low long fiber content and one or both of high extractive level or low extractive to free fatty acid ratio. Furthermore, high shear locations and/or locations where two or more streams are blended are preferred. Based on these criteria, the following locations could be treated with talc: white water tray (extractives of 11,625 mg/kg, a extractive/FFA ratio of 32, a high shear location and blended with coated broke); save-all cloudy (extractive of 2,200 mg/kg, extractive/FFA ratio of 15 and blended with coated broke and broke chest); save-all clear (extractives of 4,010 mg/kg); broke chest (a extractive/FFA ratio of 17); and coated broke (an extractive/FFA ratio of 31 and blended with white water tray and save-all cloudy).

MISTRON® talc (MISTRON is a trademark of Luzenac) was added at one or more of the above-identified locations at a dosage rate of 10 lbs of per ton of paper solids within the production process. For example, Mistron® talc was added to the suction line of the pump from the white water chest for a period of three days at a dosage rate of 10 lbs of talc per ton of paper solids within the production process. After the three-day treatment period, post-treatment water samples were collected from selected process streams for extractive analysis. Representative values of the post-treatment extractive content for the post-treatment water samples are given in Table II.

TABLE II

| Location | Free Fatty Acid (mg/kg) before addition of talc | Free Fatty Acid (mg/kg) after addition of talc | Extractives (mg/kg) before addition of talc | Extractives (mg/kg) after addition of talc |
|---|---|---|---|---|
| Save-all clear | 80 | 125 | 4,000 | 4,000 |
| Save-all cloudy | 150 | 230 | 2,000 | 1,900 |
| White water tray | 304 | 76 | 10,400 | 5,200 |

An optical scanner analyzed the paper produced before and after talc addition to the suction line of the pump from the white water chest. The optical scanner determines the number and size of holes and light spots contained within the produced paper. Representative values of the optical scanner results are presented in Table III.

TABLE III

| Scanner Hole & Spot size | Average number of spots or holes per production reel (no talc added to the white water) | Average number of spots or holes per production reel (with talc added to the white water) |
|---|---|---|
| Small holes | 4.8 | 2.1 |
| Medium holes | 2.6 | 0.5 |
| Large holes | 2.2 | 0.7 |
| Extra large holes | 13.7 | 5.4 |
| Small light spots | 155 | 64.0 |
| Medium light spots | 37 | 2.2 |
| Large light spots | 28.7 | 36.9 |
| Extra large light spots | 24.1 | 11.8 |

Example 2

One liter process water samples were collected from the high density in, high density out, blend chest, broke chest, head box, save-all cloudy, and white water tray of a papermaking circuit. A 100 gram of produced dry paper sample was collected. Each sample was analyzed for extractive and fatty acid content.

Representative values of the extractive and fatty acid levels were determined as in Example 1 and are given in Table IV.

TABLE IV

| Location and wt % fiber content | Free Fatty Acid (FFA) (mg FAA/kg sol'n) | Extractives (mg extractive/kg sol'n)* | Extractive: FFA Ratio |
|---|---|---|---|
| High density (15%) in | 49 | 1016 | 21 |
| High density (10%) out | 38 | 653 | 17 |
| Blend chest (4%) | 37 | 925 | 25 |
| Broke chest (4%) | 36 | 794 | 22 |
| Head box (1%) | 78 | 2047 | 26 |
| Paper sheets (>99%) | 103 | 2142 | 21 |
| Save-all cloudy (<1%) | 169 | 3228 | 19 |
| White water tray (<1%) | 483 | 7397 | 15 |

*The extractive levels are the average of duplicate analyses.

The locations for treating with talc are selected based on long fiber content (preferably low long fiber content), extractive level (preferably high), and extractive to free fatty acid ratio (preferably low) of the location itself and/or locations where two or more streams are blended are preferred (preferably high shear blending locations). Based on these criteria, the following locations could be treated with talc: white water tray (extractives of 7,397 mg/kg, an extractive/FFA ratio of 15, a high shear blending location); save-all cloudy (extractive of 3,228 mg/kg, extractive/FFA ratio of 19 and blending location); head box (extractives of 2,047 mg/kg); high density in (extractives of 1,016 mg/kg, extractive/FAA ratio of 21); and high density out (an extractive/FFA ratio of 17 and a high shear blending location). The white water tray is a preferred talc treatment site. The white water try water is blended with one or both of the save-all cloudy and the high density. The high density out is formed from the dilution of the high density in with the white water tray water.

Mistron® talc was added to the white water tray at a dosage rate of 10 lbs per ton of paper solids produced by the paper machine within the production process. Compared to paper produced before the addition of talc to the white water tray, the paper produced with talc being added at the white water tray eliminated spots and holes from the produced paper, reduced wash-ups (production line stoppages to remove depositions from production equipment) by 95% and paper web line breakages by 60%.

Example 3

The following example compares two papermaking lines, A and B, running under substantially identical papermaking operating conditions (same feed stock, same finish conditions and same grade of talc). Both papermaking lines were experiencing significant down time due to stickies, pitch, and wet web breaks.

One liter process water samples were collected from the save-all feed (that is, the water entering the save-all), the save-all clear, and save-all cloudy (that is, the cloudy filtrate from the save-all). Each water sample was analyzed for extractive and fatty acid content.

The extractive and talc levels were determined by the methods of Example 1. Representative values of the fatty acid and extractable content for the process streams of Lines A and B are given in Table V.

TABLE V

| Location | Free Fatty Acid (mg FAA/kg sol'n) | Extractives (mg extractive/kg sol'n)* | Extractive: FFA Ratio |
|---|---|---|---|
| Save-all Clear (line A) | 302 | 12,100 | 40 |
| Save-all Clear (line B) | 115 | 10,450 | 91 |
| Save-all cloudy (line A) | 234 | 10,530 | 45 |
| Save-all cloudy (line B) | 312 | 9,520 | 31 |
| White Water (line A) | 224 | 6,510 | 29 |
| White Water (line B) | 313 | 7,510 | 24 |

*The extractive levels are the average of duplicate analyses.

Lines A and B were treated with talc. In Line A, talc was added at a conventional talc addition location, the broke chest. 20 lbs of Mistron® talc per ton of paper solids was added to the broke chest. In Line B, talc was added to the high shear white water chest line delivering water to the save-all feed with 10 lbs of Mistron® talc at a dosage rate of 10 lbs of talc per ton of paper solids within the production process, this was half the value of talc added to conventional broke chest location of Line A.

After four days of treating lines A and B, water samples were collected for extractive and fatty acid content. Representative values of the extractive and fatty acid content during the treatment process are given in Table VI.

TABLE VI

| Location | Free Fatty Acid (mg/kg) before addition of talc | Free Fatty Acid (mg/kg) after addition of talc | Extractives (mg/kg) before addition of talc | Extractives (mg/kg) after addition of talc |
|---|---|---|---|---|
| Save-all clear (line A) | 302 | 335 | 12,100 | 13,500 |
| Save-all clear (line B) | 115 | 320 | 10,450 | 11,000 |
| Save-all cloudy (line A) | 234 | 350 | 10,530 | 16,500 |
| Save-all cloudy (line B) | 312 | 265 | 9,520 | 14,000 |
| White water (line A) | 224 | 302 | 6,510 | 8,375 |
| White water (line B) | 313 | 108 | 7,510 | 2,000 |

* The extractive levels are the average of duplicate analyses.

Representative values of the number of breaks, total average downtime per day and average downtime per break for the two lines were monitored and are summarized in Table VII.

TABLE VII

| | Conditions | Average No. of breaks per day | Total average downtime per day | Average downtime per break |
|---|---|---|---|---|
| Before talc treatment | Line A | 7.3 | 161 | 23 |
| | Line B | 6.3 | 167 | 27 |
| With talc treatment | Line A (20 lbs talc/ton to broke chest) | 9.1 | 202 | 22 |
| | Line B (10 lbs talc/ton to save-all feed line) | 2.6 | 49 | 17 |

The results of this Example show that treating high shear white water having low long fiber content with talc, as opposed to conventional talc addition locations having a high long fiber content, can significantly reduce one or more of average number of paper line breaks per day, average line downtime per break and total paper production line down time per day.

A number of variations and modifications of the invention can be used. It would be possible to provide for some features of the invention without providing others.

The present invention, in various embodiments, configurations, or aspects, includes components, methods, processes, systems and/or apparatus substantially as depicted and described herein, including various embodiments, configurations, aspects, sub-combinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A process for reducing depositional material in a paper making process, comprising contacting talc with a white water aqueous stream in a paper making process, wherein the white water aqueous stream comprises less than about 5 wt % solids such that the white water aqueous stream has a long fiber content less than about 5 wt %, wherein the talc is contacted with the white water aqueous stream after a high shear event, the high shear event resulting in formation of one or more free fatty acids, wherein the one or more free fatty acids are adsorbed by the talc.

2. The process of claim 1, wherein contacting the talc with the aqueous stream forms a depositional material-loaded talc and a depositional material-depleted aqueous stream, and wherein the depositional material-depleted aqueous stream has at least about 10 % less depositional material than the aqueous stream.

3. The process of claim 1, further comprising:

forming the aqueous stream by separating wood pulp from a wood pulp-containing aqueous stream.

4. The process of claim 1, wherein the talc is contacted with the aqueous stream at a location where the aqueous stream has a Reynolds number of at least about 2200.

5. The process of claim 1, wherein the talc is in the form of an aqueous dispersion.

6. The process of claim 1, wherein the talc has a median particle size from about 2 to about 5 microns.

7. The process of claim 1, wherein the white water aqueous stream contains less than about 2 wt % solids.

8. The process of claim 1, wherein from about 1 to about 100 lbs. of the talc are contacted with the white water aqueous stream for about each ton of solids in a fiber-containing pulp of the papermaking process.

9. The process of claim 1, further comprising, after contacting the talc with the white water aqueous stream, circulating the white water aqueous stream to another portion of the paper making process.

10. The process of claim 1, wherein the size of the one or more free fatty acids is less than 0.5 microns.

11. The process of claim 1, wherein the size of the one or more free fatty acids is less than 0.1 micron.

12. The process of claim 1, wherein the size of the one or more free fatty acids is less than 0.01 micron.

13. The process of claim 1, wherein the size of the one or more free fatty acids is less than 0.001 micron.

14. The process of claim 1, wherein the amount of at least one of the one or more free fatty acids after the step of contacting is less than 10,000 ppm.

15. A process for reducing depositional material in a paper making process, comprising separating pulp from a pulp-containing stream to form a re-circulating white water stream and adding talc to the re-circulating white water stream before introducing the re-circulating white water stream to a stream having a pulp content higher than the pulp content of the re-circulating white water stream, wherein the talc is contacted with the re-circulating white water stream after a high shear event, the high shear event resulting in formation of one or more free fatty acids, wherein the one or more free fatty acids are adsorbed by the talc.

16. A process for making paper products, comprising:

a) contacting a wood based fiber-containing material with water to form a woody fiber-containing stream;

b) contacting the woody fiber-containing stream with a pulp-retention device to form a wet paper sheet and a white water;

c) drying the wet paper sheet to form a dry paper sheet;

d) contacting the white water with talc to form a talc-containing white water; and e) circulating at least a portion of the talc-containing white water with the woody fiber-containing stream, wherein the white water is contacted with the talc after the pulp-retention device and before said circulating, wherein the talc is contacted with the white water after a high shear event, the high shear event resulting in formation of one or more free fatty acids in the white water, wherein the one or more free fatty acids are adsorbed by the talc, and wherein the one or more free fatty acids are at least one of an emulsion and a dispersion of depositional material.

17. The process of claim 16, wherein after contacting the talc with the white water a fatty acid composition within the white water is absorbed onto the talc such that free fatty acid in the white water is reduced by at least about 10 wt %.

18. The process of claim 16, wherein contacting the talc with the white water results in adsorption of the depositional material onto the talc, thereby reducing the free the depositional material content of the white water by at least about 10 wt %.

19. The process of claim 16, wherein the talc is contacted with the white water at least during the forming of the white water in step b).

20. The process of claim 19, wherein the talc comprises an aqueous dispersion.

21. The process of claim 16, wherein the talc is contacted with the white water within about 10 minutes after forming of the white water in step b).

22. The process of claim 16, wherein the talc has a median particle size from about 2 to about 5 microns.

23. The process of claim 16, wherein the white water contains less than about 2 wt % solids.

24. The process of claim 16, wherein from about 1 to about 100 lbs. of the talc are added to the white water for about each ton of solids contained within the woody fiber-containing stream.

* * * * *